US010149045B2

(12) United States Patent
Beer et al.

(10) Patent No.: US 10,149,045 B2
(45) Date of Patent: Dec. 4, 2018

(54) LOUDSPEAKER ARRAY

(71) Applicant: Fraunhofer-Gesellschaft zur Foerderung der angewandten Forschung e.V., Munich (DE)

(72) Inventors: Daniel Beer, Martinroda (DE); Lorenz Betz, Wassertruedingen (DE); Lutz Ehrig, Dresden (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 15/481,356

(22) Filed: Apr. 6, 2017

(65) Prior Publication Data

US 2017/0215003 A1 Jul. 27, 2017

Related U.S. Application Data

(63) Continuation of application No. PCT/EP2015/073255, filed on Oct. 8, 2015.

(30) Foreign Application Priority Data

Oct. 9, 2014 (DE) ..... 10 2014 220 544

(51) Int. Cl.

| | |
|---|---|
| ***H04R 1/26*** | (2006.01) |
| ***H04R 1/40*** | (2006.01) |
| ***H04R 1/02*** | (2006.01) |
| ***H04R 31/00*** | (2006.01) |

(52) U.S. Cl.

CPC ..... *H04R 1/403* (2013.01); *H04R 1/02* (2013.01); *H04R 1/025* (2013.01); *H04R 31/00* (2013.01); *H04R 2201/029* (2013.01); *H04R 2201/401* (2013.01); *H04R 2201/403* (2013.01)

(58) Field of Classification Search

USPC ..... 381/335, 164, 182, 332, 333, 336, 339, 381/386, 388

See application file for complete search history.

(56) References Cited

U.S. PATENT DOCUMENTS

| | | | | |
|---|---|---|---|---|
| 2,632,055 A | | 3/1953 | Parker | |
| 4,042,778 A | | 8/1977 | Clinton | |
| 6,158,902 A | * | 12/2000 | Staat | H04R 1/406 381/338 |
| 7,201,251 B1 | | 4/2007 | Baird | |
| 7,260,235 B1 | | 8/2007 | Henricksen et al. | |
| 9,191,734 B2 | | 11/2015 | Sporer et al. | |

(Continued)

FOREIGN PATENT DOCUMENTS

| | | |
|---|---|---|
| CN | 202261701 U | 5/2012 |
| DE | 102009010278 A1 | 8/2010 |

(Continued)

*Primary Examiner* — Yosef K Laekemariam
(74) *Attorney, Agent, or Firm* — Perkins Coie LLP; Michael A. Glenn

(57) ABSTRACT

A loudspeaker array includes an encapsulated baffle and a multitude of sound transducers. The encapsulated baffle includes a multitude of recesses arranged next to each other on a first main surface. The sound transducers of the multitude of sound transducers are arranged in the associated recesses such that an encapsulated rear volume is formed by each recess for the respective sound transducer.

16 Claims, 3 Drawing Sheets

(56) References Cited

U.S. PATENT DOCUMENTS

| | | | | |
|---|---|---|---|---|
| 2005/0271230 | A1 | 12/2005 | Sasaki | |
| 2009/0141916 | A1 | 6/2009 | Clair et al. | |
| 2012/0008812 | A1 | 1/2012 | Sporer et al. | |
| 2012/0207332 | A1* | 8/2012 | Dehe ..... | H04R 1/403 381/182 |
| 2014/0029779 | A1 | 1/2014 | Yamauchi et al. | |
| 2015/0086056 | A1 | 3/2015 | Ikuma | |

FOREIGN PATENT DOCUMENTS

| | | | |
|---|---|---|---|
| EP | 1199907 | A2 | 4/2002 |
| EP | 1947902 | A1 | 7/2008 |
| JP | 2007-036821 | A | 2/2007 |
| JP | 2007-235709 | A | 9/2007 |
| JP | 2011176581 | A | 9/2011 |
| WO | 2006/136977 | A1 | 12/2006 |
| WO | 2014/046137 | A1 | 3/2014 |

* cited by examiner

LOUDSPEAKER ARRAY

CROSS-REFERENCE TO RELATED APPLICATIONS

This application is a continuation of copending International Application No. PCT/EP2015/073255, filed Oct. 8, 2015, which claims priority from German Application No. DE 10 2014 220 544.1, filed Oct. 9, 2014, which are each incorporated herein in its entirety by this reference thereto.

BACKGROUND OF THE INVENTION

Embodiments of the present invention relate to a loudspeaker array having an encapsulated baffle and a plurality of sound transducers as well as to a manufacturing method thereof.

Loudspeaker arrays may be arranged, e.g., as line arrays or surface arrays.

Loudspeaker arrays play an increasingly important role in various acoustic irradiation scenarios. A significant advantage over conventional loudspeakers is the possibility of influencing the radiation characteristic of the loudspeaker array by individually driving each individual sound transducer.

Manufacturing loudspeaker arrays in accordance with the conventional technology is complex and can often only be realized with a great effort in terms of material and assembly. In order to avoid acoustic short circuits, the rearward sound of the array has to be isolated from the sound emitted forwardly. This is achieved by installing the loudspeaker array into a housing which may, e.g., be closed. Depending on the application, individually driving the individual loudspeakers in the array requires a separate individual housing, which may, e.g., be separated in an air-tight manner, per sound transducer in order to avoid influencing adjacent transducers by the rearward sound pressure inside of the housing. Therefore, the housing of a loudspeaker array has to be divided into so-called chambers, which requires a large amount of effort, in order to allow each individual transducer to have its own closed housing volume.

As disclosed in U.S. Pat. No. 7,201,251, an array structure may alternatively also be realized by arranging individual closed loudspeaker housings in series. However, depending on the size of the array, the effort in terms of material and assembly which is involved in both concepts presented above is accordingly high. Thus, there is a need for an improved approach.

SUMMARY

According to an embodiment, a loudspeaker array may have: a one-piece baffle comprising a multitude of blind holes arranged next to each other on a first main surface; and a multitude of sound transducers; wherein each sound transducer of the multitude of sound transducers is arranged in the associated blind hole of the multitude of blind holes such that each blind hole together with the respective sound transducer of the multitude of sound transducers forms an encapsulated rear volume for the respective sound transducer.

According to another embodiment, a method for manufacturing a loudspeaker array may have the steps of: providing a multitude of blind holes arranged next to each other in a first main surface of a one-piece baffle; and arranging a multitude of sound transducers in the associated blind holes of the multitude of blind holes, so that the rear volumes for the sound transducers are formed by the blind holes.

A first embodiment provides a loudspeaker array having an encapsulated baffle and a multitude of sound transducers. The encapsulated baffle comprises a multitude of recesses arranged next to each other on a first main surface. Each sound transducer of the multitude of sound transducers is arranged in the associated recess of the multitude of recesses such that an encapsulated rear volume is formed by each recess for the respective sound transducer.

Therefore, the core of the invention is to employ, instead of a loudspeaker housing having a multitude of chambers, an encapsulated baffle having a multitude of recesses is employed. In principle, the encapsulated baffle is a flat element having an increased thickness so that recesses, or chambers, may be formed directly therein which may form the rear volumes after inserting the sound transducers into the recesses. Hence, a simple loudspeaker construction may be manufactured which may be scaled at will both as a line array and as a surface array.

According to embodiments, the recesses are formed as blind holes, e.g., as drilled or milled blind holes, which may then comprise, e.g., round shapes but also oval shapes or even rectangular shapes. The ratio of the width to the depth of the recess is in the range of 5:1 to 1:5, 3:1 to 1:3 or in the range of 2:1 to 1:2.

According to further embodiments, it would also be conceivable for the encapsulated baffle to be configured as a sandwich construction having a plurality of (bonded and/or generally connected) layers. In this case, according to an embodiment, it is also possible that the one or several front layers (cf. first main surface) include a multitude of through holes for the recesses, while the last layer forms a rear wall which closes the recesses such that, again, blind holes are formed.

According to a further embodiment, the encapsulated baffle includes at least one sound guide, e.g., in the form of a horn, a bass reflex channel or a transmission channel.

According to a further embodiment, the encapsulated baffle may also comprise a conductor layer having conductor paths for electrically contacting the sound transducers. The arrangement thereof varies depending on the choice of material for the baffle.

A further embodiment provides a method for manufacturing a loudspeaker array. The methods include two basic steps, providing a multitude of recesses arranged next to each other in a first main surface of an encapsulated baffle and arranging a multitude of sound transducers in the associated recesses so they form the rear volumes for the sound transducers. In this embodiment, it is advantageous that the loudspeaker as a whole may be manufactured in a very simple and, therefore, inexpensive manner.

In manufacturing, the step of providing the multitude of recesses arranged next to each other may be effected in one method step either by inserting the recesses into a carrier plate via milling or drilling or by direct molding, e.g., by casting or injection molding. All of the above-mentioned production methods offer the advantage that simple and fast production is possible both from one part as well as from several parts, while production, or at least production of the housing, may also be effected in a fully automatic manner due to the low level of complexity.

BRIEF DESCRIPTION OF THE DRAWINGS

Embodiments of the present invention will be detailed subsequently referring to the appended drawings, in which.

DETAILED DESCRIPTION OF THE INVENTION

Figure 1A:
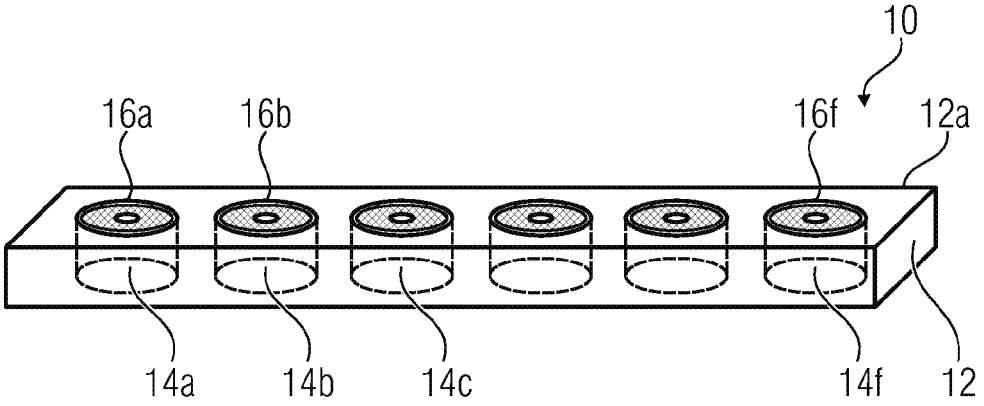
FIG. 1*a* shows a schematic 3D illustration of a linear loudspeaker array according to a first embodiment.

Before embodiments of the present invention will be subsequently explained in detail with reference to the figures, it shall be pointed out that identical elements and structures are provided with identical reference numerals so that their descriptions are interchangeable and mutually applicable.

FIG. 1*a* shows a linear loudspeaker array 10. The linear loudspeaker array includes an elongated encapsulated baffle 12 having a total of six sound transducers 16*a* to 16*f* arranged in series. The encapsulated baffle 12 is made, e.g., from wood or aluminum or a different housing material having a sufficient wall thickness so that 1×6 recesses 14*a* to 14*f* may be inserted therein. The recesses 14*a* to 14*f* are provided as blind holes arranged next to each other and, in correspondence with the sound transducers 16*a* to 16*f*, are also arranged in series. For the sake of completeness, it shall be pointed out that all recesses 14*a* to 14*f* are arranged on the same main surface 12*a* of the encapsulated baffle 12. The multitude of sound transducers 16*a* to 16*f*, which are arranged in the corresponding recesses 14*a* to 14*f*, are also provided on this very main surface 12*a*. At this point it should be noted that the recesses 14*a* to 14*f* may be manufactured, for example, by milling or drilling blind holes into the carrier plate 12 or directly by means of injection molding.

Due to this arrangement of the sound transducers 16*a* to 16*f* in the recesses 14*a* to 14*f*, one encapsulated rear volume, which is also designated by reference numerals 14*a* to 14*f* for the sake of clarity, is formed by the recess 14*a* to 14*f*, respectively, for the corresponding sound transducer 16*a* to 16*f*. The multitude of rear volumes 14*a* to 14*f* for the multitude of sound transducers 16*a* to 16*f* are separated from one another and may also be referred to as being acoustically decoupled. Thus, the rear volumes 14*a* to 14*f* form so-called individual housings directly in the housing material 12, the individual housings being separated from one another such that they cannot influence one another through the rearward sound. Compared to conventional chambers of a loudspeaker, imperfections of the airtight separation, e.g., due to holes or assembly tolerances, cannot occur. The volumes 14*a* to 14*f* are approximately of the same size. A further advantage is the high strength of a housing 12 manufactured in this way and the high internal dampening due to the perforated plate or plate structure resembling, e.g., a honeycomb core.

At this point it should be noted that the multitude of sound transducers 16*a* to 16*f* are advantageously, but not necessarily, embodied as sound transducers of the same type so that an array is formed by the arrangement. By driving the individual sound transducers 16*a* to 16*f* differently, the sound may be radiated from the array 10 in a directed manner, wherein the direction may be varied via the manner in which the sound transducers 16*a* to 16*f* are driven.

Figure 1B:
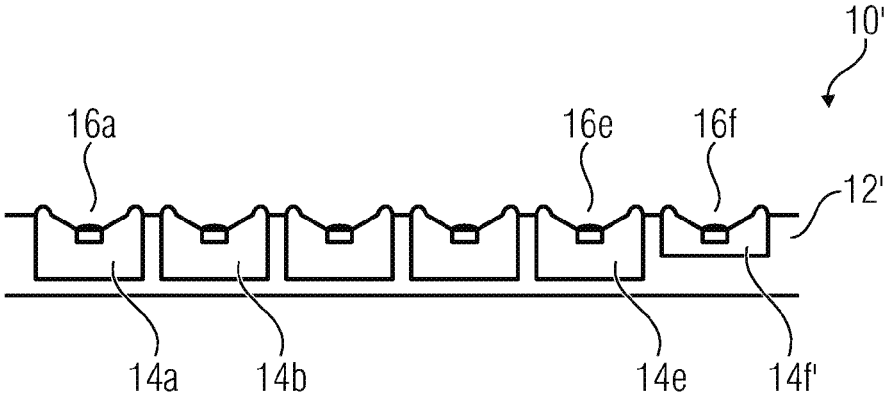
FIG. 1*b* shows a schematic sectional illustration of a further linear loudspeaker array according to a further embodiment.

In FIG. 1*b*, an embodiment having a variable housing volume is shown. FIG. 1*b* shows a loud speaker array 10' having six sound transducers 16*a* to 16*f* arranged in the encapsulated baffle 12'. The recesses 14*a* to 14*e* correspond to the recesses 14*a* to 14*e* in FIG. 1*a*, whereas the recess 14*f* is reduced in size.

In this sectional view, it may be seen that the recesses 14*a* to 14*e* extend almost over the entire thickness of the encapsulated baffle 12'. Here, the ratio of the depth to the width is approximately 1:1.5. The recess 14*f'* has a reduced depth and, thus, a reduced encapsulated rear volume, the ratio of depth to width being approximately 1:2. Even if the sound transducer 16*f* employs the same type of sound transducer as the sound transducers 16*a* to 16*e*, the sound transducer 16*f* comprises a modified characteristic due to the reduced encapsulated rear volume 14*f'*. As can also be seen here, the borehole distance between the 1×n recesses 14*a* to 14*f'* is approximately constant.

Alternatively, it would also be conceivable that, instead of or in addition to varying the depth of the blind hole 14*f'*, the diameter or width of the recess 14*f'* is varied in order to create a modified characteristic. In the case of a variation of the diameter or widening of the recess 14*f'*, a different sound transducer 16*f* is typically employed due to the modified dimensions. Alternatively, a conical borehole may be used so that the transducer opening continues match the sound transducer 16*f*.

Figure 2:
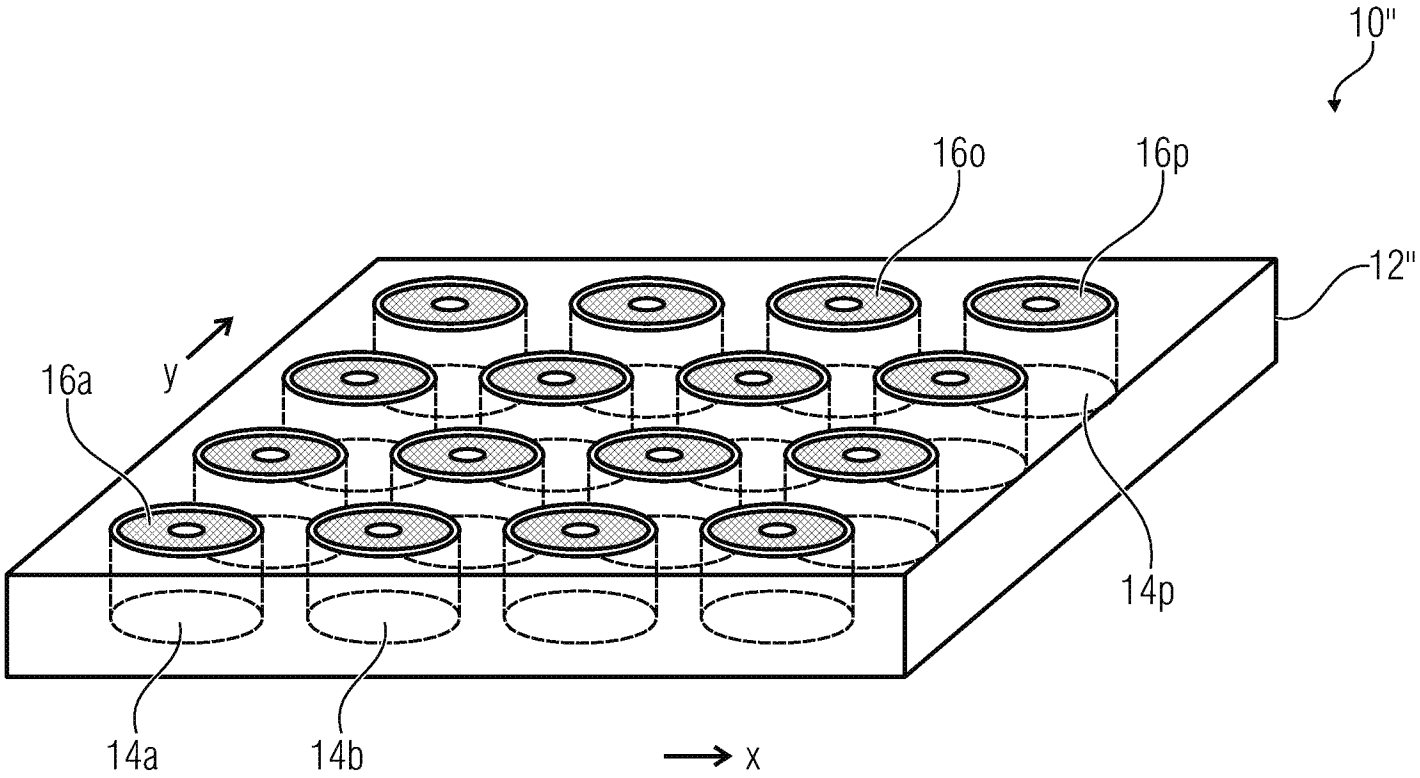
FIG. 2 shows a schematic 3D illustration of a flat-panel loudspeaker array according to a further embodiment.

FIG. 2 shows a flat loudspeaker array 10". This includes a flat encapsulated baffle 12" in which 4×4 recesses 14*a* to 14*p* are inserted which serve as rear volumes 14*a* to 14*p* for the sound transducers 16*a* to 16*p*. As can be seen, the recess 14*a* to 14*p* as well as the sound transducers 16*a* to 16*p* are arranged as a 4×4 matrix and/or a general m×m matrix, the drilling distance between the individual recesses 14*a* to 14*p* optionally being the same in the X as well as in the Y directions.

Figure 3A:
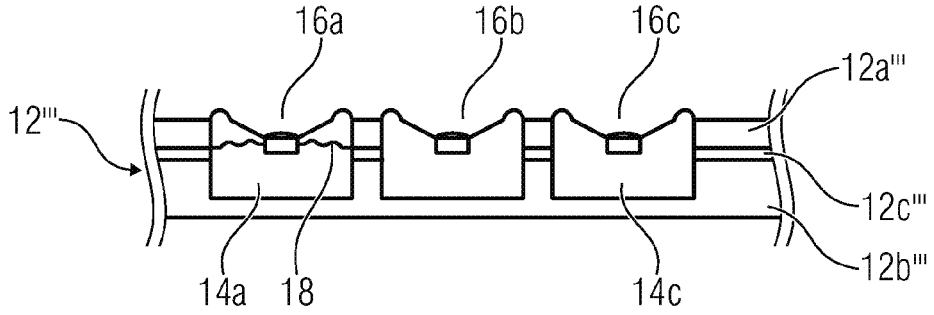
FIG. 3*a* shows a schematic sectional illustration of a loudspeaker array having an encapsulated baffle as a sandwich construction according to a further embodiment.
Figure 3B:
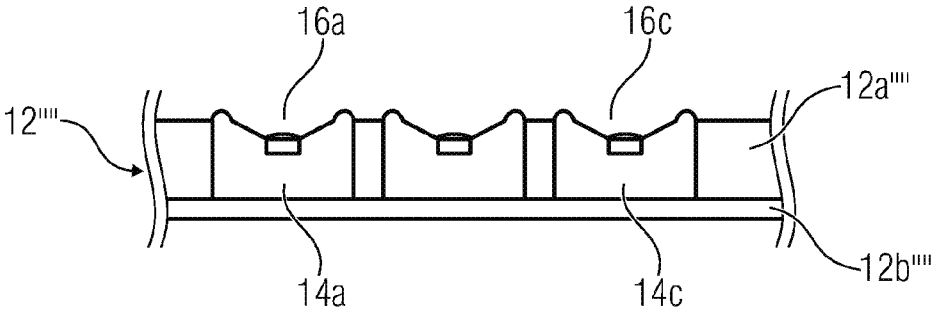
FIG. 3*b* shows a schematic sectional illustration of a loudspeaker array having an encapsulated baffle as a sandwich construction and a superimposed rear wall according to a further embodiment.
Figure 3C:
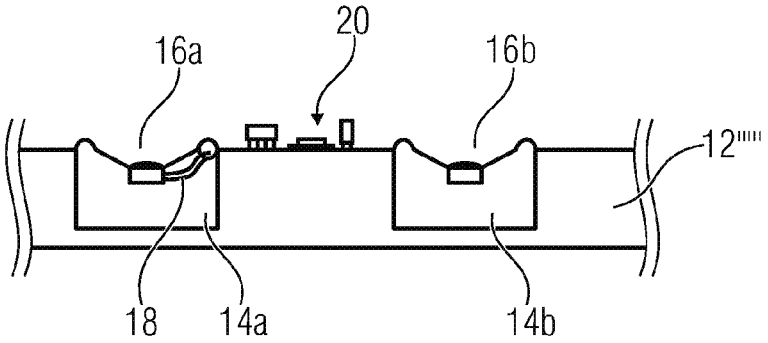
FIG. 3*c* shows a schematic sectional illustration of a loudspeaker array having additional drive electronics according to an additional embodiment.

With reference to FIGS. 3*a* to 3*c*, the sub-variations for the flat loudspeaker array 10" of FIG. 2 and the line-shaped loudspeaker array 10 and 10' of FIGS. 1*a* and 1*b*, respectively, will be explained.

FIG. 3*a* shows an encapsulated baffle 12''' embodied as a sandwich-construction. For this purpose, the encapsulated baffle includes a first front layer 12*a'''* forming the main surface for arranging the loudspeakers 16*a* to 16*c*, and a second rear layer 12*b'''*. Optionally, an intermediate layer 12*c'''* may be provided between the layers 12*a'''* and 12*b'''*. The recesses 14*a* to 14*c* are formed in this very sandwich including the three layers 12*a'''*, 12*b'''* and 12*c'''*.

According to embodiments, the intermediate layer 12*c'''* may include one or several conductor paths for electrically contacting the loudspeakers 16*a* to 16*c*. This electrical contacting is indicated, by way of example, by means of the contacts 18 for the loudspeaker 16*a*, which contact the resonance coil for the membrane of the loudspeaker. Depending on the choice of material of the layers 12*a'''* and 12*b'''*, the loudspeaker signal or a part thereof may also be realized via these layers. Thus, it would be conceivable that a conductive layer 12*a'''* and 12*b'''* forms the ground contact for the transducers 16*a* to 16*c*.

FIG. 3*b* shows a further encapsulated baffle 12"" also embodied as sandwich construction. In this case, the sandwich construction includes a front layer 12*a*"" having a plurality of through bore holes (also referred to as a perforated plate) and a rear layer 12*b*"' forming the rear wall and thus not having any clearance. This embodiment is advantageous in that the housing volumes 14*a* to 14*c* are configured in the perforated plate 12*a*"" by the plurality of through bore holes after being joined with the rear wall 12*b*"'. Such a construction is improved in terms of production expenditure since through bore holes are very easy to manufacture as compared to blind holes.

FIG. 3*c* shows a further encapsulated baffle 12"" having the recesses 14*a* and 14*b* embodied as blind holes. Driving electronics 20 for the loudspeakers 16*a* and 16*b* is provided on the encapsulated baffle 12"" at the first main surface. The driving electronics 20 may be configured, e.g., to coordinate individual driving of the plurality of sound transducers of the array. Here, the baffle may include and/or have integrated therewith a so-called cooling layer which realizes the possibly required heat dissipation (cooling surface) in places.

The driving electronics 20 is connected to the transducers 16*a* and 16*b* by means of wires, herein exemplarily illustrated by means of the contact wires 18 for the loudspeaker 16*a*. Alternatively, it would also be conceivable for the connection to be embodied by means of conductor paths, as explained with reference to FIG. 3*a*. It should be noted that it is not of importance in this embodiment whether the encapsulated baffle 12"" is embodied as a sandwich construction or in one piece in this embodiment.

With reference to the above-mentioned embodiments, it shall be pointed out that the sound transducers 16*a* to 16*e* employed may be classical reciprocating sound transducers having a membrane and an oscillator coil, but may also be electrostatic sound transducers or miniature loudspeakers, e.g., MEMS speakers.

According to further embodiments, so-called sound guides, e.g., horns, bass reflex channels or transmission line channels may be integrated into the carrier material of the encapsulated baffle.

With reference to the above-mentioned embodiments, it should also be noted that instead of conductor path layers or in addition to conductor path layers, the encapsulated baffle may comprise milled-out portions for the cabling of the single loudspeakers.

With reference to FIG. 3*a*, it shall be pointed out that the conductor path layer 12*c*"' needs not necessarily be embodied as an intermediate layer but may also be arranged on the first main surface or a further main surface. In this respect, it is obvious to the person skilled in the art that the conductor path layer 12*c*"' is not only used in conjunction with sandwich constructions.

With reference to FIG. 3*c*, it should be noted that the driving electronics 20 may also be arranged on the second opposing main surface (that is to say, on the rear side) or may also be inserted into a further recess such that it is flush with the surface.

The element sometimes referred to as a "blind hole" above is a recess in the sense of a cavity or indent, and is defined by the fact that, when viewed from the plane of the front side, an opening extends into the baffle which is closed within the baffle. Further, a formation (e.g., a plastic plate provided by deep-drawing) which is curved in such a way that the volumes project beyond the plate thickness is understood as a blind hole. In this case, on the one hand, any shape of the blind hole (round, rectangular or free-shaped) and, on the other hand, any hole profile in the depth, i.e., a linear, a conical or another shape corresponding to an arbitrary mathematical function course, would be conceivable.

It should be further noted that, when referring to an encapsulated housing, a person skilled in the art understands both a closed housing and a housing having a resonator, e.g., in the sense of a Helmholtz resonator, i.e., a bass reflex housing, or also a housing having a passive membrane.

Further embodiments relate to a manufacturing method for the loudspeaker array. In the basic variant, this includes the steps of "providing a plurality of recesses arranged next to each other in a first main surface of the baffle" and "arranging a plurality of sound transducers in the associated recesses of the plurality of recesses" so that the rear volumes for the encapsulated baffle are formed by the recesses. According to further embodiments, the first step of providing the plurality of recesses may be effected either by milling, by drilling or by machining in general. Alternatively, the recesses could also be created in the solid material by other material removal methods (e.g., by energy blasting) or by chemical means. Alternatively, it would also be conceivable for the encapsulated baffle to be manufactured directly with the recesses in a forming manner, e.g., as a deep-drawing product, or in a molding manner as a casting product or injection-molding product.

With reference to the above-mentioned embodiments, it shall be pointed out that the loudspeaker assemblies on a circuit board (loudspeaker housing directly milled into a multi-layer circuit board) serve for illustrations purposes only, whereas the scope will be defined by the following claims.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. A loudspeaker array comprising:

a one-piece baffle comprising a multitude of blind holes arranged next to each other on a first main surface; and a multitude of sound transducers;

wherein each sound transducer of the multitude of sound transducers is arranged in the associated blind hole of the multitude of blind holes such that each blind hole together with the respective sound transducer of the multitude of sound transducers forms an encapsulated rear volume for the respective sound transducer.

2. The loudspeaker array according to claim 1, wherein the multitude of sound transducers is arranged as a 1×m line array; or wherein the multitude of sound transducers is arranged as an nxm surface array.

3. The loudspeaker array according to claim 1, wherein each recess comprises a round, oval or rectangular shape.

4. The loudspeaker array according to claim 1, wherein a ratio of the width to the depth of the recess is provided in the ratio of 3:1 to 1:3.

5. The loudspeaker array according to claim 1, wherein the blind holes are milled.

6. The loudspeaker array according to claim 1, wherein the encapsulated baffle comprises a conductor path layer in which a multitude of conductor paths are formed for electrically contacting the multitude of sound transducers.

7. The loudspeaker array according to claim 1, wherein a drive electronics is arranged on the first main surface or on a second main surface opposite the first main surface or within the encapsulated baffle, said drive electronics being configured for driving the multitude of sound transducers.

8. The loudspeaker array according to claim 1, wherein the blind holes extend almost over the entire thickness of the one-piece baffle.

9. The loudspeaker array according to claim 1, wherein a drive electronics is arranged in the encapsulated baffle, said drive electronics being configured for driving the multitude of sound transducers.

10. The loudspeaker array according to claim 1, wherein sound guides, horns, bass reflex channels and/or transmission line channels are integrated into a carrier material of the encapsulated baffle.

11. A method for manufacturing a loudspeaker array, comprising:

providing a multitude of blind holes arranged next to each other in a first main surface of a one-piece baffle; and arranging a multitude of sound transducers in the associated blind holes of the multitude of blind holes, so that the rear volumes for the sound transducers are formed by the blind holes.

12. The method according to claim 11, wherein providing the multitude of recesses arranged next to each other comprises the sub-steps of providing a carrier plate and inserting a multitude of recesses by means of milling.

13. The method according to claim 11, wherein providing the multitude of recesses arranged next to each other comprises deep-drawing, casting or injection molding.

14. The loudspeaker array according to claim 1, wherein the one-piece baffle is formed by a multi-layer circuit board.

15. The loudspeaker array according to claim 14, wherein the sound transducers are MEMS transducers.

16. The loudspeaker array according to claim 14, wherein the multi-layer circuit board comprises a conductor path layer in which a multitude of conductor paths are formed for electrically contacting the multitude of sound transducers.

* * * * *